US007646349B2

(12) United States Patent
Wee

(10) Patent No.: US 7,646,349 B2
(45) Date of Patent: Jan. 12, 2010

(54) MOBILE TERMINAL FOR REDUCING SPECIFIC ABSORPTION RATE

(75) Inventor: Hee Geol Wee, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 90 days.

(21) Appl. No.: 11/832,863

(22) Filed: Aug. 2, 2007

(65) Prior Publication Data

US 2008/0158065 A1 Jul. 3, 2008

(30) Foreign Application Priority Data

Dec. 28, 2006 (KR) ..... 10-2006-0136205

(51) Int. Cl.
*H01Q 1/24* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS

| | | | | |
|---|---|---|---|---|
| 7,119,743 | B2 * | 10/2006 | Iguchi et al. | 343/700 MS |
| 2004/0090371 | A1 * | 5/2004 | Rossman | 343/700 MS |
| 2006/0145923 | A1 * | 7/2006 | Autti | 343/700 MS |
| 2007/0109202 | A1 * | 5/2007 | Vance | 343/702 |
| 2007/0210969 | A1 * | 9/2007 | Vance | 343/702 |

FOREIGN PATENT DOCUMENTS

| | | |
|---|---|---|
| JP | 07-111411 | 4/1995 |
| KR | 10-2002-0055852 | 7/2002 |
| KR | 10-2003-0077108 | 10/2003 |
| KR | 10-2005-0004435 | 1/2005 |

* cited by examiner

*Primary Examiner*—HoangAnh T Le
(74) *Attorney, Agent, or Firm*—H.C. Park & Associates, PLC

(57) ABSTRACT

A mobile terminal that may reduce a specific absorption rate (SAR) includes a case, a circuit board in the case, a ground in the circuit board, an antenna pattern, and a ground pattern spaced apart from the antenna pattern and made of a material that absorbs electromagnetic waves. The ground pattern is connected to the ground of the circuit board or an auxiliary ground.

7 Claims, 4 Drawing Sheets

MOBILE TERMINAL FOR REDUCING SPECIFIC ABSORPTION RATE

CROSS REFERENCE TO RELATED APPLICATION

This application claims priority from and the benefit of Korean Patent Application No. 10-2006-0136205, filed on Dec. 28, 2006, which is hereby incorporated by reference for all purposes as if fully set forth herein.

BACKGROUND OF THE INVENTION

1. Field of the Invention

The present invention relates to a mobile terminal that may reduce a specific absorption rate, and more particularly, to a mobile terminal that may reduce a specific absorption rate and includes an antenna pattern and a ground pattern.

2. Discussion of the Background

Due to the rapid development of communication technology using mobile terminals, the mobile terminal has become popular. Accordingly, the average time spent using a mobile terminal has rapidly increased. Therefore, concern about whether electromagnetic waves radiated from the mobile terminal have a harmful influence on a human body has increased.

A Specific Absorption Rate (SAR) is generally used as a numerical value for indicating the degree of harmful influence on a human body caused by electromagnetic waves radiated from the mobile terminal. The SAR is the electric power absorbed per unit mass of a human body cell, measured in units of W/kg. The SAR of a human body is measured using a device called a human body phantom, which has an electric constant similar to human body tissue, because it is difficult to directly measure a human body. The SAR is represented by the following equation:

$$SAR = \frac{1}{2}\left(\frac{\sigma}{\rho}\right)|Ei|^2$$

where $\sigma$ is the conductivity of a human body phantom, $\rho$ is density, and $|Ei|^2$ is the peak value of a local electric field vector.

The SAR in human body tissue is proportional to the square of electric field strength within the tissue and is determined by parameters of the incident electromagnetic field, such as the frequency, strength, direction, and source of an electromagnetic field, the relative position of a target object, genetic properties of a characteristic tissue of an exposed human body, and the ground effect and exposed environment effect.

Several countries have established and regulate safety standards regarding human body exposure to electromagnetic waves based on the SAR. In order to satisfy SAR standards, various methods of reducing the SAR may be used when manufacturing a mobile terminal.

One such method is to coat Electro Magnetic Interference (EMI) paints on the mobile terminal's case. The EMI paints provide an electromagnetic shielding effect by electromagnetically separating the opposite sides of a closed curved surface of a metal body. When EMI paints are coated on the mobile terminal's case, electromagnetic waves generated within the case may not radiate from the mobile terminal. It may also prevent the generation of static electricity and electrification. While this method has an influence on the EMI and electromagnetic susceptibility (EMS) of a terminal, it does not fundamentally decrease the influence of electromagnetic waves radiated from the antenna. Further, in theory, when EMI paints are coated on the mobile terminal, the SAR to the human body may increase by re-reflection generated due to EMI paints.

Another method is to arrange various parts within the mobile terminal in consideration of the SAR. However, rearrangement of various parts within the mobile terminal in order to reduce the SAR may negatively affect communication quality and/or the external shape of the mobile terminal.

SUMMARY OF THE INVENTION

The present invention provides a mobile terminal that may reduce a SAR by forming a ground pattern that may absorb electromagnetic waves around an antenna pattern.

The present invention also provides a mobile terminal wherein an antenna pattern and a ground pattern are formed in a position spaced apart from a ground by connecting the ground pattern to the ground with a metal member.

Additional features of the invention will be set forth in the description which follows, and in part will be apparent from the description, or may be learned by practice of the invention.

The present invention discloses a mobile terminal including a case, a circuit board, a ground in the circuit board, an antenna pattern, and a ground pattern. The circuit board is provided in the case. The ground pattern is spaced apart from the antenna pattern and made of a material that absorbs electromagnetic waves. The ground pattern is connected to the ground of the circuit board.

The present invention also discloses a mobile terminal including a case, a circuit board including a ground, an auxiliary ground, an antenna pattern, and a ground pattern. The case contains the circuit board. The auxiliary ground is spaced apart from the ground of the circuit board. The ground pattern is spaced apart from the antenna pattern and includes a material that absorbs electromagnetic waves. The ground pattern is also connected to the auxiliary ground.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
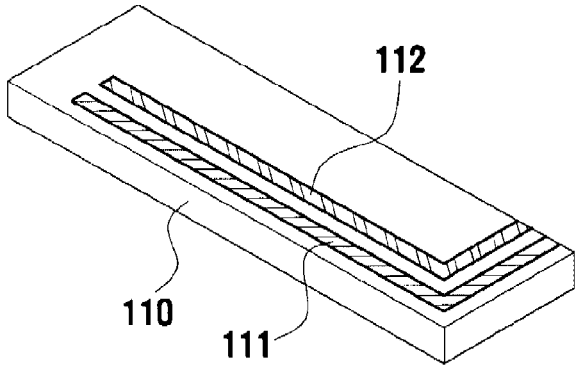
FIG. 1 is a perspective view showing an antenna carrier for a case of a mobile terminal according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

FIG. 1 is a perspective view showing an antenna carrier for a case of a mobile terminal according to an exemplary embodiment of the present invention.

As shown in FIG. 1, an antenna pattern 111 is formed in an antenna carrier 110. An antenna is a device for transmitting and receiving electromagnetic waves for the purpose of wireless communication. Considering the mobile terminal design and user convenience, the antenna may be formed in the shape of the antenna pattern 111 shown in FIG. 1. In the present exemplary embodiment, the antenna pattern 111 is formed in the antenna carrier 110. In another exemplary embodiment, the antenna pattern 111 may be formed within a case of the mobile terminal. The shape of the antenna pattern 111 is determined considering the radiation performance and space arrangement of the mobile terminal. One end of the antenna pattern 111 is connected to a reception point of the mobile terminal.

A ground pattern 112 is also formed in the antenna carrier 110. The ground pattern 112 is made of a material that can absorb electromagnetic waves. In the present exemplary embodiment, the ground pattern 112 is made of copper. In other exemplary embodiments, the ground pattern 112 may be made of metals other than copper or a material that can absorb electromagnetic waves. The ground pattern 112 reduces the SAR of the mobile terminal by absorbing electromagnetic waves radiated from the antenna pattern 111.

The ground pattern 112 and the antenna pattern 111 are spaced apart from each other. The distance between the group pattern 112 and the antenna pattern 111 is determined considering the radiation performance of the antenna pattern 111 and the SAR of the mobile terminal. A short distance between the ground pattern 112 and the antenna pattern 111 may reduce the SAR; however, the ground pattern 112 has increased influence on the radiation performance of the antenna pattern 111. On the other hand, a far distance between the ground pattern 112 and the antenna pattern 111 may reduce the influence of the ground pattern 112 on the radiation performance of the antenna pattern 11, but increase the SAR.

In the present exemplary embodiment, the distance between the ground pattern 112 and the antenna pattern 111 is 3 mm. In other exemplary embodiments, the distance between the ground pattern 112 and the antenna pattern 111 may be modified considering the radiation performance of the antenna pattern 111 and the SAR of the mobile terminal. However, the smaller size of the mobile terminal also decreases the internal space of the mobile terminal. Thus, the distance between the ground pattern 112 and the antenna pattern 111 may not exceed 1 cm.

One end of the ground pattern 112 is connected to a ground formed in the mobile terminal. The ground may be a ground of a circuit board of the mobile terminal or an auxiliary ground formed for the ground pattern 112.

Figure 2:
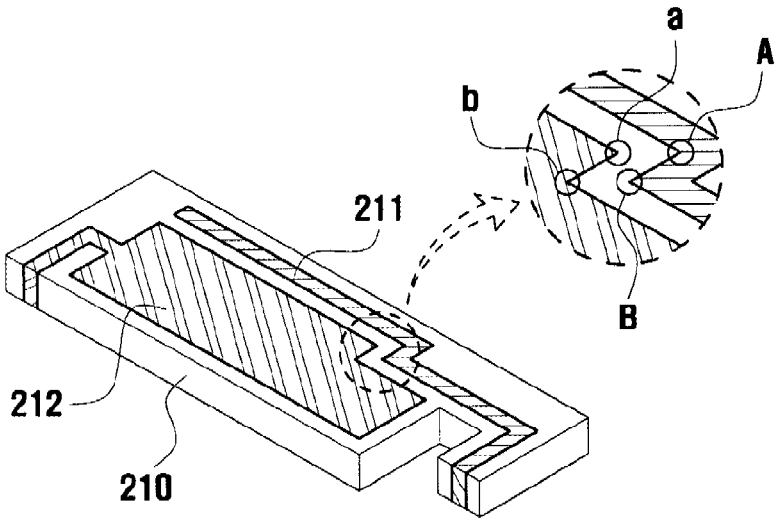
FIG. 2 is a perspective view showing an antenna carrier for a case of a mobile terminal according to another exemplary embodiment of the present invention.

FIG. 2 is a perspective view showing an antenna carrier for a a mobile terminal case of another exemplary embodiment of the present invention.

As shown in FIG. 2, an antenna pattern 211 formed in an antenna carrier 210 may have at least one bending portion. When the antenna pattern 211 has a bending portion, the length of the antenna pattern 211 may be extended and a radiation point of the antenna pattern 211 may be positioned at a desired place. However, when the antenna pattern 211 has a bending portion, electromagnetic waves are radiated at the bending portion.

A ground pattern 212 has at least one bending portion corresponding to the bending portion of the antenna pattern 211. As shown in FIG. 2, the ground pattern 212 has a bending portion 'a' corresponding to a bending portion A of the antenna pattern 211, and a bending portion 'b' corresponding to a bending portion B of the antenna pattern 211. Since the ground pattern 212 has a bending portion corresponding to the bending portion of the antenna pattern 211, the ground pattern 212 may more effectively absorb electromagnetic waves radiated from the antenna pattern 211.

The ground pattern 212 need have only the corresponding bending portion in one side facing the antenna pattern 211. As shown in FIG. 2, the ground pattern 212 may not have a corresponding bending portion at the side that does not face the antenna pattern 211. Accordingly, the ground pattern 212 may have a large size. A larger ground pattern 211 may absorb more electromagnetic waves, which may reduce the SAR of the mobile terminal.

Figure 3:
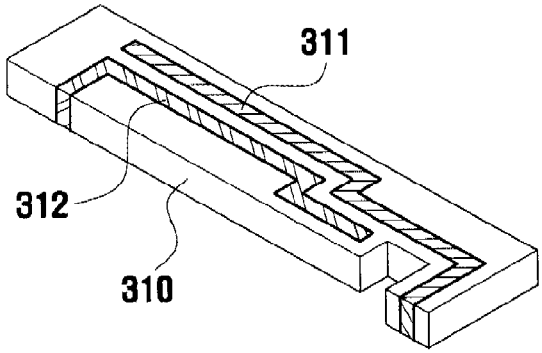
FIG. 3 is a perspective view showing an antenna carrier for a case of a mobile terminal according to another exemplary embodiment of the present invention.

FIG. 3 is a perspective view showing an antenna carrier for a mobile terminal case according to another exemplary embodiment of the present invention.

As shown in FIG. 3, a ground pattern 312 formed in an antenna carrier 310 may have a bending portion corresponding to the bending portion of an antenna pattern 311. However, if the antenna carrier 310 has similar dimensions to the antenna carrier 210 shown in FIG. 2, the ground pattern 312 may have a smaller overall size than the ground pattern 212 shown in FIG. 2. Accordingly, the ground pattern 312 shown in FIG. 3 may absorb fewer electromagnetic waves than the ground pattern 211 shown in FIG. 2. However, the smaller internal space of the mobile terminal may require the ground pattern 312. In this case, efficient use of the internal space of the mobile terminal may reduce the size of the mobile terminal.

Figure 4:
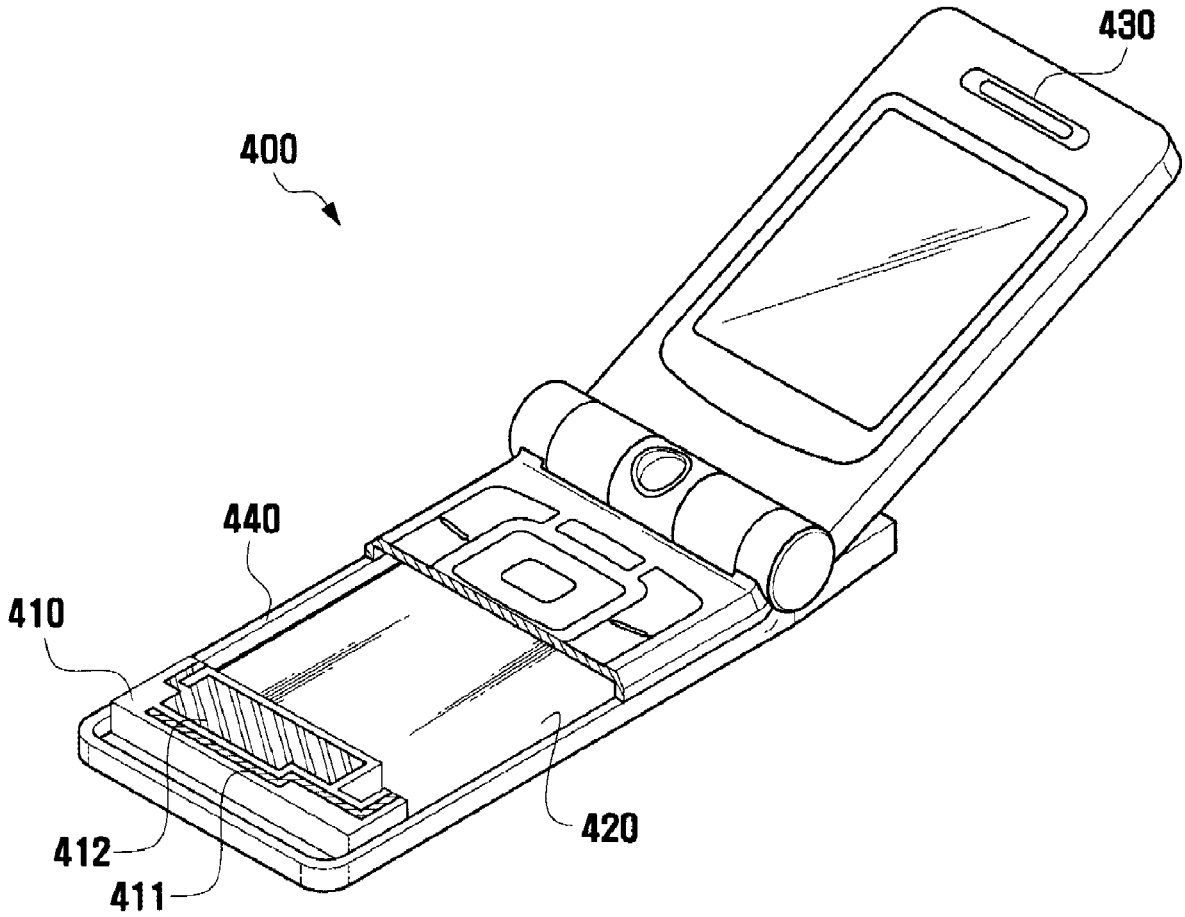
FIG. 4 is a perspective view showing an antenna carrier provided in a case of a mobile terminal according to another exemplary embodiment of the present invention.

FIG. 4 is a perspective view showing an antenna carrier provided in a mobile terminal case of another exemplary embodiment of the present invention.

As shown in FIG. 4, a speaker 430 may be provided in an upper part of a case 440 of a mobile terminal 400, and a microphone (not shown) may be provided at a lower end of the case 440. Accordingly, when a user uses the mobile terminal 400, the speaker 430 may be positioned adjacently to the user's ear, and the microphone may be positioned around the user's mouth. The present exemplary embodiment exemplifies a folder type mobile terminal 400, but may be similarly applied to a flip type mobile terminal or a slide type mobile terminal.

Where to form an antenna pattern 411 and a ground pattern 412 in an antenna carrier 410 is determined considering various design aspects of the mobile terminal 400.

In this exemplary embodiment of the present invention, the antenna carrier 410 of the mobile terminal 400 is provided beside the microphone. Accordingly, by arranging the position of the antenna pattern 411 through which electromagnetic waves are radiated from the mobile terminal 400 as far away as possible from the user's brain, electromagnetic waves absorbed into the user's brain may be reduced. However, in the mobile terminal 400 according to another exemplary embodiment of the present invention, the antenna carrier 410 may alternatively be provided beside the speaker 430.

When the antenna carrier 410 is provided beside the microphone, the ground pattern 412 is spaced apart from a ground (not shown) of the circuit board of the mobile terminal 400. In this case, the ground pattern 412 and the ground of the circuit board are connected to each other through a metal member. In the present exemplary embodiment, the metal member is a metal plate 420 inserted inside of the mobile terminal 400. In other exemplary embodiments, the metal member may be formed in a different pattern. The use of the metal member has freed the antenna carrier 410 position that had been limited by a ground position of the circuit board.

Figure 5:
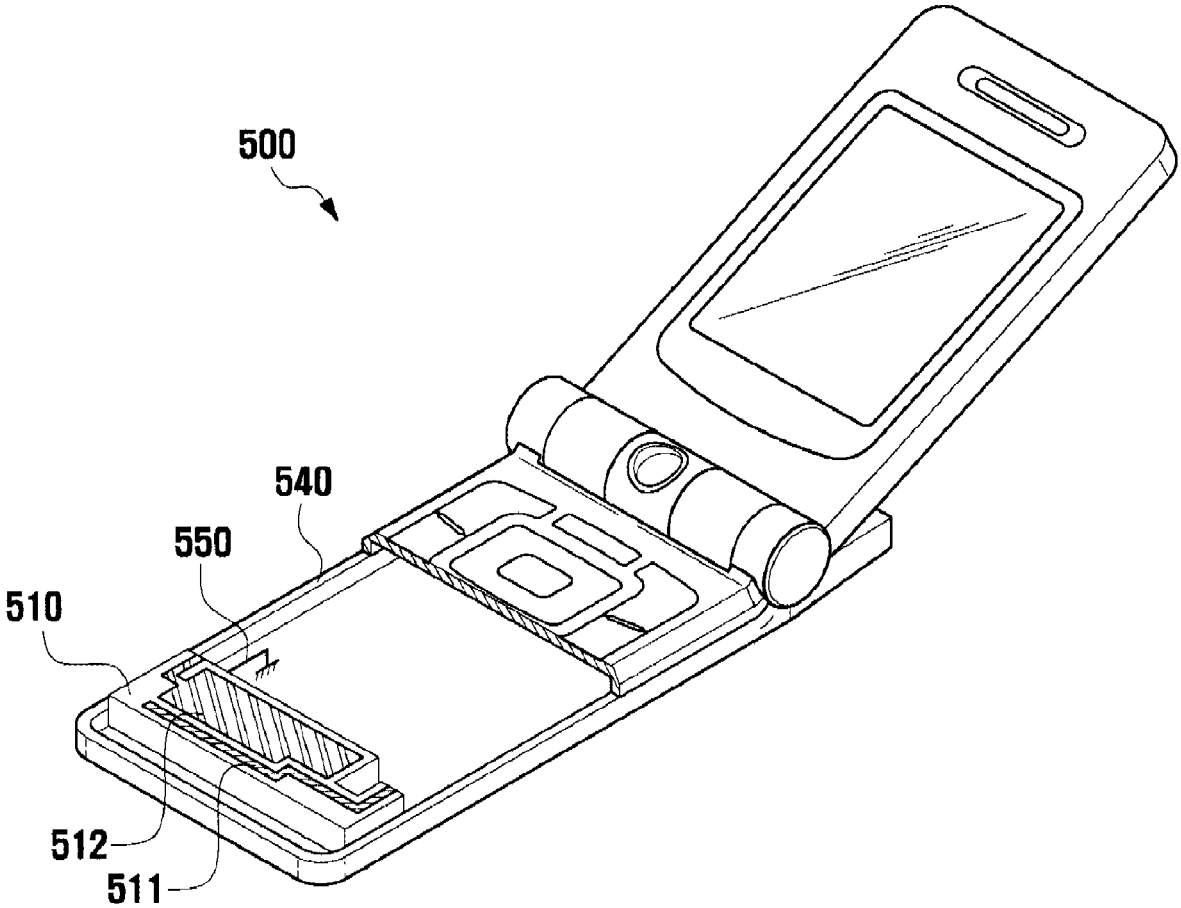
FIG. 5 is a perspective view showing an antenna carrier provided in a case of a mobile terminal according to another exemplary embodiment of the present invention.

FIG. 5 is a perspective view showing an antenna carrier provided in a mobile terminal 500 case according to another exemplary embodiment of the present invention.

The mobile terminal 500 includes an auxiliary ground 550 formed in a case 540. The auxiliary ground 550 is formed in a position separated from a ground of the circuit board. A ground pattern 512 is connected to the auxiliary ground 550. As the ground pattern 512 is connected to the auxiliary ground 550, instead of to the ground of the circuit board, limitations on positioning an antenna carrier 510 may be reduced. By designing the mobile terminal 500 in a desired form, a position of the antenna carrier 510 may be determined, and the auxiliary ground 550 may thus be formed at an appropriate position. If the auxiliary ground 550 is formed at a position at which it contacts the ground pattern 512, the ground pattern 512 and the auxiliary ground 550 may be connected to each other without using a metal member similar to that shown in FIG. 5.

Due to space restriction of the mobile terminal 500, the auxiliary ground 550 may be spaced apart from the antenna carrier 510. In this case, the ground pattern 512 and the auxiliary ground 550 may be connected to each other through a metal member.

Figure 6:
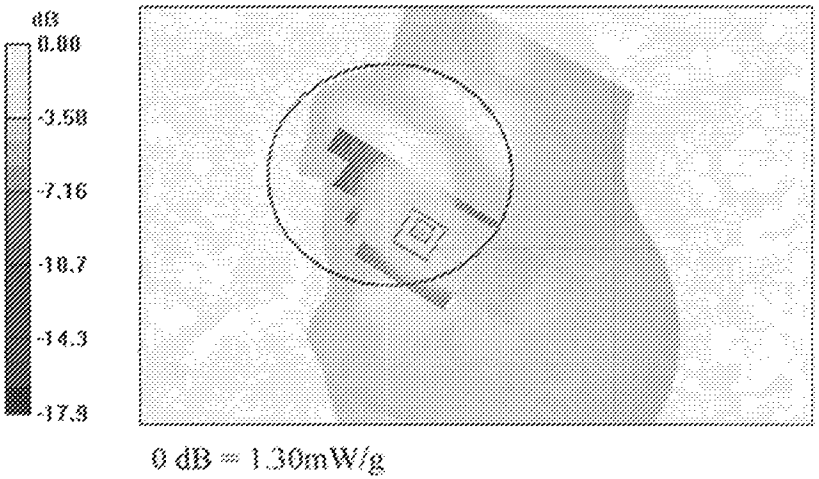
FIG. 6 shows a SAR result measured in a mobile terminal according to another exemplary embodiment of the present invention.

FIG. 6 shows a SAR result measured in a mobile terminal according to another exemplary embodiment of the present invention.

The present experimental data was measured using a human phantom having an electric constant similar to human tissue.

FIG. 6(*a*) shows a SAR of a mobile terminal in which a ground pattern is not formed, and FIG. 6(*b*) shows a SAR of a mobile terminal in which a ground pattern is formed, wherein the distance between an antenna pattern and the ground pattern is 3 mm.

When a ground pattern is not formed, the highest value of the SAR is 2.78 mW/g, and the 1 g SAR value (that is, the average SAR in a volume of 1 gram of tissue) is 2.4 mW/g. When the ground pattern is formed, the highest value of the SAR is 1.33 mW/g, and the 1 g SAR value is 1.22 mW/g. The 1 g SAR value therefore decreases from 2.4 mW/g to 1.22 mW/g. Also, as shown in FIG. 6(*b*), although the hot point (the point where the SAR is highest) does not move, the field strength of the hot point decreases.

As seen from the experimental results, a SAR is lower when the ground pattern is formed than when the ground pattern is not formed.

The mobile terminal according to an exemplary embodiment of the present invention is a mobile electronic device for mobile communication such as a mobile phone and Personal Digital Assistant (PDA).

As described above, according to the present invention, forming a ground pattern for absorbing electromagnetic waves around an antenna pattern may reduce a SAR of a mobile terminal.

Further, by connecting the ground pattern and a ground using a metal member, the antenna pattern may be formed at a position separated from the ground. Therefore, in the mobile terminal, the position of the antenna carrier may be determined regardless of the ground position.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A mobile terminal, comprising:

a case;

a circuit board in the case;

a ground in the circuit board;

an antenna pattern connected to a reception point; and a ground pattern spaced apart from the antenna pattern and comprising a material that absorbs electromagnetic waves, wherein the antenna pattern and the ground pattern are arranged in the same plane of an antenna carrier, wherein the ground pattern is connected to the ground in the circuit board, wherein the antenna pattern has at least one bending portion, and the ground pattern has at least one bending portion corresponding to the at least one bending portion of the antenna pattern.

2. The mobile terminal of claim 1, further comprising a metal member, wherein the ground pattern is connected to the ground of the circuit board through the metal member.

3. The mobile terminal of claim 1, wherein the at least one bending portion of the ground pattern is disposed only at a side of the ground pattern facing the antenna pattern.

4. A mobile terminal, comprising:

a case;

a circuit board in the case and comprising a ground;

an auxiliary ground spaced apart from the ground;

an antenna pattern connected to a reception point; and a ground pattern spaced apart from the antenna pattern and comprising a material that absorbs electromagnetic waves, wherein the antenna pattern and the ground pattern are arranged in the same plane of an antenna carrier, wherein the ground pattern is connected to, but not integrally formed with, the auxiliary ground, wherein the antenna pattern has at least one bending portion, and the ground pattern has at least one bending portion corresponding to the at least one bending portion of the antenna pattern.

5. The mobile terminal of claim 4, wherein the auxiliary ground is formed in the case.

6. The mobile terminal of claim 4, further comprising a metal member, wherein the ground pattern is connected to the auxiliary ground through the metal member.

7. The mobile terminal of claim 4, wherein the at least one bending portion of the ground pattern is disposed only at a side of the ground pattern facing the antenna pattern.

* * * * *